United States Patent [19]

Shima et al.

[11] 4,394,537

[45] Jul. 19, 1983

[54] SOUND REPRODUCTION DEVICE

[75] Inventors: Kenji Shima; Masahiro Hibino, both of Hyogo, Japan

[73] Assignee: Mitsubishi Denki Kabushiki Kaisha, Tokyo, Japan

[21] Appl. No.: 272,549

[22] Filed: Jun. 11, 1981

[30] Foreign Application Priority Data

Jun. 12, 1980 [JP] Japan ..... 55-80368

[51] Int. Cl.[3] ..... H04H 5/00

[52] U.S. Cl. ..... 179/1 G; 179/1 GP

[58] Field of Search ..... 179/1 G, 1 GP

[56] References Cited

U.S. PATENT DOCUMENTS 4,149,036 4/1979 Okamoto et al. ..... 179/1 G X 4,308,423 12/1981 Cohen ..... 179/1 G 4,329,544 5/1982 Yamada ..... 179/1 G X

*Primary Examiner*—R. J. Hickey

*Attorney, Agent, or Firm*—Staas & Halsey

[57] ABSTRACT

A sound reproducing device particularly adapted for use in the passenger compartment of an automobile and having improved stereo separation and symmetrical frequency characteristics. The device includes a high-pass filter circuit for passing, when a leakage signal occurs, a signal of equal frequency component to the leakage signal, an attenuation circuit for attenuating the level of the signal passed through the filter circuit to the level of the leakage signal, and a phase inverting circuit for inverting the phase of the signal thus attenuated so as to be opposite to that of the leakage signal, thereby to cancel out the leakage signal.

7 Claims, 4 Drawing Figures

SOUND REPRODUCTION DEVICE

BACKGROUND OF THE INVENTION

The present invention relates to sound reproducing devices for producing stereophonic sound in narrow spaces, such as the passenger compartment of an automobile. More particularly, the invention relates to an improved sound reproducing device of this general type in which the stereo effect is enhanced.

When the listener listens to sound from such a sound reproducing device in the passenger compartment of an automobile, he feels as if the sounds are coming from a narrow room. This is the so-called "closed-room effect". Furthermore, in the passenger compartment of an automobile, the listener is near the the loudspeakers so that he hears sounds coming directly from the loudspeakers. That is, he hears the sounds as if he were near the sound source. This increases the closed-room effect even more.

Therefore, heretofore, in order to eliminate the above-described problems, signals having frequency components in middle and high sound frequency ranges, which give a high directional effect, were applied mutually to the opposite channels to decrease the directional effect and to thereby increase the acoustic spreading effect. In each channel, a signal obtained by delaying frequency components in a high range are applied to provide a reverberation effect, thereby to reduce the closed-room effect.

A conventional sound reproducing device which utilizes the above-described reverberation and spreading effects will be described with reference to FIG. 1.

In FIG. 1, reference character 1L designates an input terminal to which is applied a signal L (left) in a two-channel stereo system, 1R an input terminal to which is applied a signal R (right), 2 an addition circuit in which a signal-R which is obtained by inverting the phase of the signal R is added to the signal L, 4 a filter circuit, 3 a voltage amplifying or attenuating circuit for changing the amplitude of the signal $L-R$ which has passed through the addition circuit 2, 5 an addition circuit in which the output of the filter circuit 4 (i.e. a signal $L_1-R_1$) is added to the signal L from the input terminal 1L to output a signal $L+L_1-R_1$, 6 an addition circuit in which a signal obtained by inverting the phase of the output signal $L_1-R_1$ from the filter circuit 4 is added to the signal R from the input terminal 1R to output a signal $R+R_1-L_1$, 7 a high-pass filter circuit, 8 a phase shift or delay circuit, 9 an addition circuit in which the output signal $L+L_1-R_1$ from the addition circuit 5 is added to the output signal $L_2-R_2$ from the phase shift or delay circuit 8 to provide a signal $L+L_1+L_2-R_1-R_2$, and 10 an addition circuit in which a signal obtained by inverting the phase of the output signal $L_2-R_2$ from the circuit 8 is added to the output signal $R+R_1-L_1$ from the addition circuit 6 to output a signal $R+R_1+R_2-L_1-L_2$.

Further in FIG. 1, reference character 11L designates a power amplifier circuit for the signal $L+L_1+L_2-R_1-R_2$, 11R a power amplifier circuit for the signal $R+R_1+R_2-L_1-L_2$, and 12L and 12R left and right loudspeakers, respectively. In FIG. 1, the signs (+) and (−) beside the addition circuits 2, 5, 6, 9 and 10 are intended to mean direct addition of a signal without phase inversion, and addition of a signal after its phase has been inverted, respectively.

As is apparent from FIG. 1, the two channel signals in the circuit are symmetrical. That is, when either of the two signals passes to the channel opposite to its own, its phase is inverted, but when it returns to its own channel, the phase is restored.

FIG. 2A shows a circuit P for simultaneously providing the two signals which are applied to addition circuits 5, 6, 9 and 10 with the phase of one of the signals maintained unchanged and the phase of the other inverted. In FIG. 2A, reference characters 13 and 14 designate resistors which are equal or substantially equal in resistance to each other, 15 a biasing resistor having a high resistance, Tr an NPN transistor, B2 the base terminal of the transistor Tr, C2 the collector terminal of the transistor Tr, E2 the emitter terminal of the transistor Tr, 16 an input terminal of the circuit P, 17 an inverted output terminal at which a signal obtained by inverting the phase of a signal applied to the input terminal 16 is provided, and 18 a non-inverted output terminal at which a signal applied to the input terminal is provided without being subjected to phase inversion.

FIG. 2B is an equivalent circuit Q of the circuit P shown in FIG. 2A. It may be noted that the biasing resistor 15 is not shown in FIG. 2B. In FIGS. 2A and 2B, like parts are designated by like reference numerals or characters. In FIG. 2B, reference character i designates a base current and Bi a current source. The current source Bi produces an output in a magnitude of B times the base current i to the emitter terminal E2.

Circuits P as shown in FIG. 2A are inserted between the input terminal 1R and the addition circuits 2 and 6, between the filter circuit 4 and the circuits which are the addition circuits 5 and 6 and the high-pass filter circuit 7, and between the phase shift or delay circuit 8 and the addition circuits 9 and 10.

The operation of the above-described circuitry for providing the reverberation and spreading effects will be described.

The phase of the signal R applied to the input terminal 1R is inverted by the circuit P to obtain the signal $-R$. The signal $-R$ is added to the signal L from the input terminal 1L in the addition circuit 2 as a result of which the difference signal component $L-R$, representing the difference between the right and left signals, is provided. The signal $L-R$, after being amplified to a suitable value by the voltage amplifying or attenuating circuit 3, is applied to the filter circuit 4.

The difference signal component $L-R$ includes a relatively large amount of reverberation component. This reverberation component is extracted by the addition circuit 2. From the reverberation component, the difference signal $L_1-R_1$ having a frequency component in a range of about 100 Hz to 1.2 KHz, to which the ear is especially sensitive is filtered by the filter circuit 4 where a frequency component which produces a stronger reverberation effect is emphasized by a resonance circuit in the filter circuit 4. The signal $L_1-R_1$ is added to the signal L in the addition circuit 5. Furthermore, the signal $L_1-R_1$ is added to the signal R in the addition circuit 6, after its phase has been inverted by the circuit P. As a result, a reverberation effect and, expecially a spreading effect are provided by the sound from the loudspeakers 12L and 12R.

Next, the signal $L_1-R_1$ having a relatively large amount of reverberation component, after passing through the filter circuit 4, is applied to the high-pass filter circuit 7, which is adapted to damp a low frequency component, where a signal component in a relatively high frequency range and having strong directional effect is extracted. The signal thus extracted is applied to the phase shift or delay circuit 8 where it is subjected to phase inversion or time delay to provide a signal $L_2-R_2$. The signal $L_2-R_2$ is added to the signal $L+L_1-R_1$ in the addition circuit 9. Furthermore, the signal $L_1-R_1$ is added to the signal $R+R_1-L_1$ in the addition circuit 10 after its phase has been inverted. Because of the phase inversion and the time delay, a spreading effect and, especially, a reverberation effect are produced by the sound from the loudspeakers 12L and 12R.

As is apparent from the above description, the conventional sound reproducing device employs the circuit P as shown in FIG. 2 for obtaining the inverted outputs. The signal $L_1-R_1$ from the filter circuit 4 is applied to the input terminal 16 of the circuit X. The signal $L_1-R_1$, which is provided at the non-inverted output terminal 18 with its phase maintained unchanged, is added to the signal L applied to the addition circuit 5 from which the resultant signal $L+L_1-R_1$ is applied to the addition circuit 9. On the other hand, the signal $R_1-L_1$ having its phase inverted is provided at the inverted output terminal 17. The signal $R_1-L_1$ thus provided is added to the signal R from the input terminal 1R in the addition circuit 6 from which the resultant signal $R+R_1-L_1$ is supplied to the addition circuit 10.

With the circuits P connected so that the signals are processed as described above, when the signal L applied to the addition circuit 5 from the input terminal is introduced to the addition circuit 9, a small part of the signal L will leak into the addition circuit 6. Similarly, when the signal R applied to the addition circuit 6 from the input terminal 1R is introduced to the addition circuit 10 a small part of the signal R tends to leak into the addition circuit 5 from the addition circuit 6. However, leakage of the signal R is never caused because of the presence of the circuit P. That is, the left signal L leaks into the opposite channel but the right signal R does not because of the provision of the circuit P. This will be described with reference to the equivalent circuit Q of the circuit P.

When the small part of the signal L, i.e. the small leakage signal, passes to the equivalent circuit Q from the non-inverted output terminal 18, it affects the base current i and therefore the current source Bi is also affected thereby. Thus, the leakage current flows from the emitter terminal E2 to the collector terminal C2 and to the inverted output terminal 17. In other words, a small leakage signal L' flows from the addition circuit 5 to the addition circuit 6.

When part of the signal R flows to the circuit Q from the inverted output terminal 17, it can reach the collector terminal C2 but it cannot affect the base current i, and therefore the current source Bi is not affected thereby. Thus, leakage current will not appear at the emitter terminal E2. In other words, part of the signal R, i.e. the leakage current, will not flow from the circuit 6 to the circuit 5.

The above-described phenomenon occurs between the addition circuits 9 and 10 also. A part of the signal $L+L_1-R_1$ applied to the addition circuit 9 from the addition circuit 5, i.e., a small leakage signal $L''+L_1''-R_1''$, leaks into the addition circuit 10 from the additional circuit 9.

Because of the above-described phenomenon, the sound from the right and left loudspeakers is not symmetrical. Even if the difference signal output is made zero, the leakage of signals cannot be prevented without providing a circuit which completely separates the right and left signal paths. Therefore, the leakage of signals make the asymmetry of the sound from the right and left loudspeakers and the leakage of signals make bad the degree of separation between the right and left channels.

Moreover, if the difference output signal is not zeroed, the conventional sound reproducing device suffers from a drawback that the asymmetry of the right and left frequency characteristics is increased, especially, in the middle and high frequency ranges.

SUMMARY OF THE INVENTION

Accordingly, an object of the present invention is to eliminate the above-described drawbacks accompanying a conventional sound reproducing device. More specifically, an object of the invention is to provide a sound reproducing device in which the above-described leakage signal is cancelled out to thereby improve the degree of separation between the right and left channels and to make symmetrical the right and left frequency characteristics.

The foregoing object and other objects of the invention have been achieved by the provision of a sound reproducing device which, according to the invention, includes a high-pass filter circuit for passing a frequency component having the same frequency range as that of a leakage signal which contains essentially middle and high frequency components, an attenuation circuit for attenuating the level of the signal passed through the filter circuit substantially to that of the leakage signal, and a phase inversion circuit for inverting the phase of the signal thus attenuated to cancel out the leakage signal.

The principle, nature and utility of the invention will become more apparent from the following detailed description and the appended claims when read in conjunction with the accompanying drawings.

DESCRIPTION OF THE PREFERRED EMBODIMENTS

Figure 3:
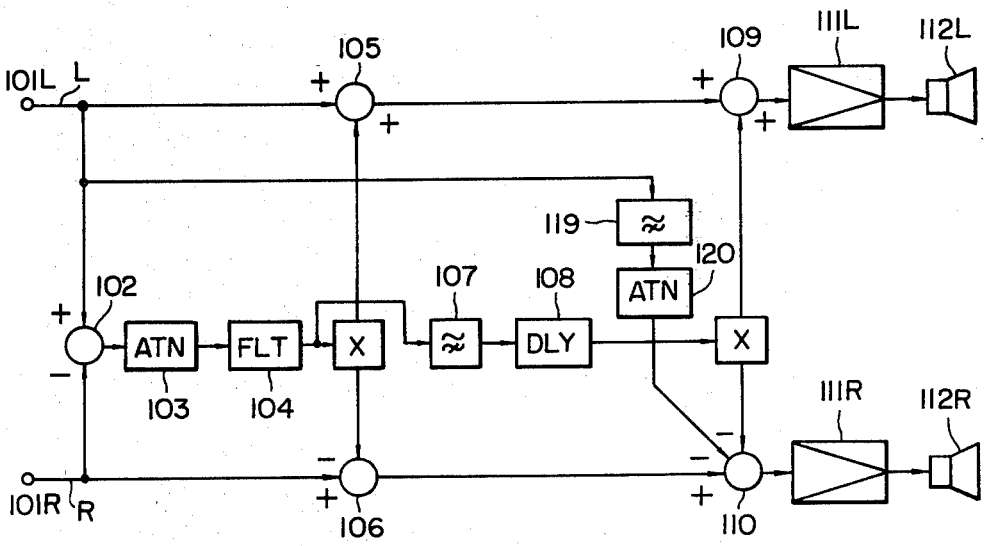
FIG. 3 is a block diagram of a preferred embodiment of a sound reproducing device constructed according to the invention.

A preferred embodiment of a sound reproducing device constructed according to the invention is shown in FIG. 3.

Figure 1:
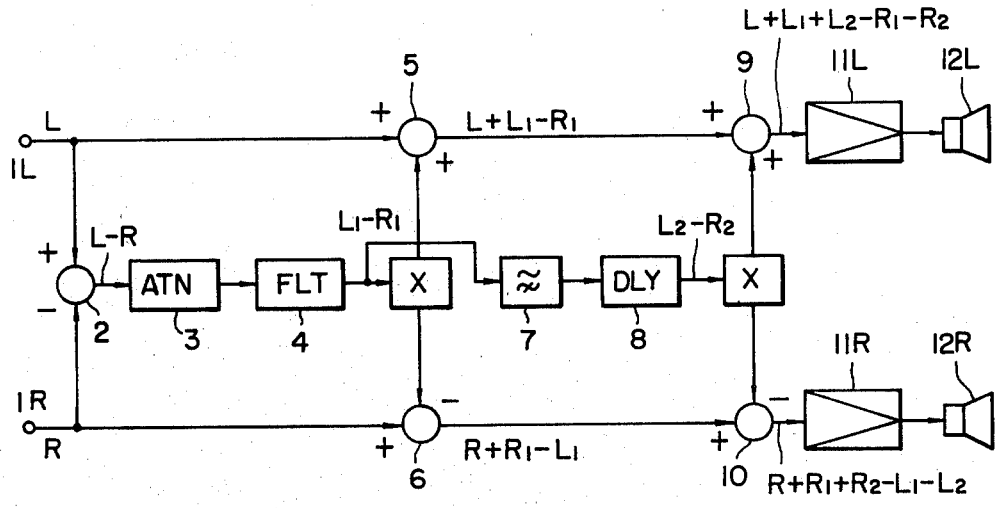
FIG. 1 is a block diagram showing a conventional sound reproducing device which is used to listen to stereophonic sound in a narrow space such as the passenger compartment of an automobile.

In FIG. 3, reference character 101L designates an input terminal functionally similar to 1L in FIG. 1, 101R an input terminal functionally similar to 1R in FIG. 1, 102 an addition circuit similar to 2 in FIG. 1, 103 a voltage amplifying or attenuating circuit similar to 3 in FIG. 1, 104 a filter circuit similar to 4 in FIG. 1, 105 an addition circuit similar to 5 in FIG. 1, 106 an addition circuit similar to 6 in FIG. 1, 107 a high-pass filter circuit similar to 7 in FIG. 1, 108 a phase shift or delay circuit similar to 8 in FIG. 1, 109 and 110 addition circuits similar to 9 and 10 in FIG. 1, 111L and 111R power amplifier circuits similar to 11L and 11R in FIG. 1 and 112L and 112R loudspeakers similar to 12L and 12R in FIG. 1. The operations of these circuit elements are also similar to the operation of the corresponding elements in FIG. 1.

Further in FIG. 3, reference numeral 119 designates a high-pass filter circuit and 120 an attenuation circuit serving as a compensation circuit.

Figure 2A:
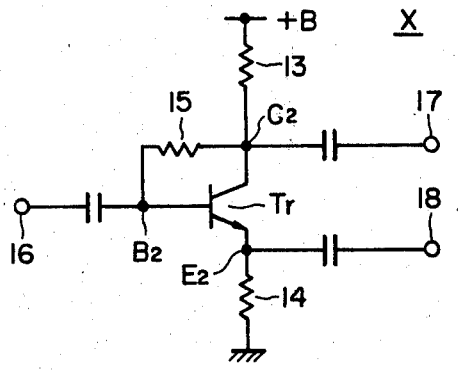
FIG. 2A is a circuit diagram showing a circuit for inverting the phases of signals in the conventional sound reproducing device.

In the sound reproducing device thus constructed, with the right and left signal paths connected through the circuits X for providing inverted outputs as shown in FIG. 2A, then a part of the left signal L applied to the addition circuit 105 through the input terminal 101L, namely, a small leakage signal L', flows from the addition circuit 105 to the addition circuit 106 while a part of the signal $L+L_1-R_1$ applied to the addition circuit 109 from the addition circuit 105, namely, a small leakage signal $L''+L_1''-R_1''$, flows from the addition circuit 109 to the addition circuit 110.

Figure 2B:
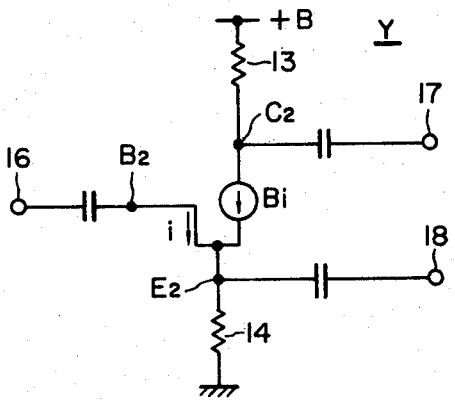
FIG. 2B is an equivalent circuit of the circuit shown in FIG. 2A.

These leakage signals L' and $L''+L_1'-R_1''$ flow into the circuits P through the non-inverted output terminals 18 reaching the inverted output terminals 17. This will be described with reference to equivalent circuit Q of the circuit P. It may be noted that the biasing resistor 15 is not shown in FIG. 2B.

The signal applied through the non-inverted output terminal 18 acts to vary the base current i. The current source Bi is affected in association with the change of the base current i to apply current B times the base current i to the emitter terminal E2. Therefore, the leakage signal flows from the emitter terminal E2 to the collector terminal C2 and the leakage signal L' or $L''+L_1''-R_1''$ appears at the inverted output terminal 17. On the other hand, the signal applied to the circuit Q through the inverted output terminal 17 can reach the collector terminal C2 but cannot affect the base current and accordingly cannot vary the output current from the current source Bi. Thus, the signal introduced through the inverted output terminal 17 cannot reach the non-inverted output terminal 18.

Thus, the leakage signals L' and $L''+L_1''-R_1''$ are in phase with the respective signals $L_1-R_1$ and $L_2-R_2$ applied to the non-inverted output terminal 18 because the circuit P is equivalent to a grounded base amplifier circuit. Accordingly, the leakage signal L' mixed with the signal between the addition circuits 106 and 110 and the leakage signal $L''+L_1''-R_1''$ applied at the addition circuit 110 are in phase with the signal L at the input terminal 101L.

Therefore, a signal $L+L_1+L_2-R_1-R_2$ is applied to the power amplifier circuit 111L from the addition circuit 109 while a signal $R+R_1+R_2-L_1-L_2+L'+L''+L_1''-R_1''$ is applied to the power amplifier circuit 111R from the addition circuit 110. The leakage current $L'+L''+L_1''-R_1''$ flowing to the power amplifier circuit 111R makes the right and left frequency characteristics asymmetrical. In order to cancel out the leakage signal $L'+L''+L_1''-R_1''$ by applying to the addition circuit 110 a signal which is the same as the leakage signal but opposite in phase, the high-pass filter circuit 119 and the attenuation circuit 120 are provided. The signal $R_1''$ is very small compared to the signal $L'+L''+L_1''$, and therefore the signal $-R_1''$ can be disregarded. That is, all that is necessary is to cancel out the variational component of the signal L, namely, the signal $L'+L''+L_1''$.

In order to extract the middle and high frequency components of the leakage signal $L'+L''+L_1''$ in which asymmetry is especially significant, the signal L applied through the input terminal 1L is applied to the high-pass filter circuit 119. The middle and high frequency signal outputted by the filter circuit 119 is applied to the attenuation circuit 120 where its level is set substantially to that of the leakage signal $L'+L''+L_1''$. The output signal of the attenuation circuit 120, which is substantially qual in level to the leakage signal, is applied to a phase inversion circuit (not shown) where its phase is inverted so that, when it is subjected to addition in the addition circuit 110, it cancels out the leakage signal. The output signal from the addition circuit 110 is applied to the power amplifier circuit 111R.

As a result, the leakage signal, which would otherwise make the right and left frequency components applied to the loudspeaker 112R asymmetrical, is cancelled out, the degree of separation between the right and left channels becomes satisfactory, and the right and left frequency characteristics are made symmetrical.

An experiment was conducted with a high-pass filter circuit 119 which was a primary filter having a cut-off frequency of about 150 Hz, and with an attenuation circuit 120 having an attenuation factor of about −36 dB. With this experiment, it was confirmed that the degree of separation was improved by about 15 dB.

It goes without saying that the attenuation factor of the attenuation circuit changes greatly with the addition of the leakage signal, and the characteristic of the high-pass filter circuit 119 is also greatly affected by other circuit constants.

In FIG. 3, the signal cancelling the leakage signal is applied to the addition circuit 110. However, the invention is not limited thereto or thereby. That is, the cancelling signal may be applied to a different point if the same effect can be obtained. However, it is believed that the best result can be obtained by applying the signal to the addition circuit 110 in the sound reproducing device described above.

The sound reproducing device adapted for use in the passenger compartment of an automobile according to the invention eliminates the difficulties of the closed-room effect and degradation of separation. However, the technical concept of the invention is applicable not only to a sound reproducing device in such an application but also to any sound reproducing device of this general type in which the degree of separation is degraded by leakage signals.

What is claimed is:

1. A sound reproducing device operatively connected to first and second loudspeakers and operatively connected to receive a stereo signal including left and right signals, comprising:

first main signal path circuit means for transmitting a first one of the left and right signals of the stereo signal to the first loudspeaker;

second main signal path circuit means for transmitting a second one of the right and left signals of the stereo signal to the second loudspeaker;

means for producing a difference signal equal to the difference between the right and left signals;

means for varying said difference signal to produce a varied difference signal;

first addition means for adding the varied difference signal to said first one of the left and right signals in said first main signal path circuit means;

second addition means for adding a signal whose phase is opposite to the phase of said varied difference signal to said second one of the left and right signals in said second main signal path circuit means;

means for phase shifting said varied difference signal to produce a phase shifted varied difference signal;

third addition means for adding said phase shifted varied difference signal to said first one of the left and right signals in said first main signal path circuit means;

fourth addition means for adding to the second one of the left and right signals in said second main signal path circuit means a signal whose phase is opposite to the phase of said phase shifted varied difference signal; and means for converting one of the left and right signals from one of said first and second main signal path circuit means and applying the converted signal to the other of said first and second main signal path circuit means so as to substantially compensate the one of said left and right signals in the other of said first and second main signal path circuit means.

2. The device as claimed in claim 1 wherein said conversion means comprises a filter circuit and a compensation circuit operatively coupled to said filter circuit.

3. The device as claimed in claim 2 wherein said compensation circuit comprises an attenuation circuit and a phase conversion circuit coupled in series with one another.

4. The device as claimed in claim 2 wherein said filter circuit comprises a high-pass filter circuit.

5. The device as claimed in claim 3 wherein said phase conversion circuit comprises means for converting a phase of a signal passed through said attenuation circuit to a phase which is required to compensate said signal in the other of said first and second main signal path circuit means.

6. A sound reproducing device operatively connected to first and second loudspeakers and operatively connected to receive a stereo signal including left and right signals, comprising:

first main signal path circuit means for transmitting a first one of the left and right signals of the stereo signal to the first loudspeaker;

second main signal path circuit means for transmitting a second one of the right and left signals of the stereo signal to the second loudspeaker;

means for producing a difference signal equal to the difference between the right and left signals;

means for varying said difference signal to produce a varied difference signal;

first addition means for adding the varied difference signal to said first one of the left and right signals in said first main signal path circuit means;

second addition means for adding a signal whose phase is opposite to the phase of said varied difference signal to said second one of the left and right signals in said second main signal path circuit means;

means for phase shifting and delaying said varied difference signal to produce a phase shifted varied difference signal;

third addition means for adding said delayed phase shifted varied difference signal to said first one of the left and right signals in said first main signal path circuit means;

fourth addition means for adding to the second one of the left and right signals in said second main signal path circuit means a signal whose phase is opposite to the phase of said delayed phase shifted varied difference signal; and means for converting one of the left and right signals from one of said first and second main signal path circuit means and applying the converted signal to the other of said first and second main signal path circuit means so as to substantially compensate the one of said left and right signals in the other of said first and second main signal path circuit means.

7. A sound reproducing device operatively connected to first and second loudspeakers and operatively connected to receive a stereo signal including left and right signals, comprising:

first main signal path circuit means for transmitting a first one of the left and right signals of the stereo signal to the first loudspeaker;

second main signal path circuit means for transmitting a second one of the right and left signals of the stereo signal to the second loudspeaker;

means for producing a difference signal equal to the difference between the right and left signals;

means for varying said difference signal to produce a varied difference signal;

first addition means for adding the varied difference signal to said first one of the left and right signals in said first main signal path circuit means;

second addition means for adding a signal whose phase is opposite to the phase of said varied difference signal to said second one of the left and right signals in said second main signal path circuit means;

means for delaying said vary difference signal to produce a delayed varied difference signal;

third addition means for adding said delayed varied difference signal to said first one of the left and right signals in said first main signal path circuit means;

fourth addition means for adding to the second one of the left and right signals in said second main signal path circuit means a signal whose phase is opposite to the phase of said delayed varied difference signal; and means for converting one of the left and right signals from one of said first and second main signal path circuit means and applying the converted signal to the other of said first and second main signal path circuit means so as to substantially compensate the one of said left and right signals in the other of said first and second main signal path circuit means.

* * * * *